US008683920B1

(12) United States Patent
Oropeza

(10) Patent No.: US 8,683,920 B1
(45) **Date of Patent: *Apr. 1, 2014**

(54) CONTAINER TAMPING SYSTEM

(71) Applicant: Jesus R. Oropeza, Yuma, AZ (US)

(72) Inventor: Jesus R. Oropeza, Yuma, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/632,398

(22) Filed: Oct. 1, 2012

(51) Int. Cl.

| | |
|---|---|
| ***B30B 15/30*** | (2006.01) |
| ***B65B 1/20*** | (2006.01) |
| ***B65B 63/02*** | (2006.01) |
| ***B30B 9/30*** | (2006.01) |

(52) U.S. Cl.
CPC ..... *B30B 9/3042* (2013.01)
USPC ..... 100/229 A; 100/215; 141/73; 53/527

(58) Field of Classification Search
USPC ..... 141/73, 81, 249, 258, 264, 320–323; 53/527, 529; 100/215, 229 A
See application file for complete search history.

(56) References Cited

U.S. PATENT DOCUMENTS

| | | | | |
|---|---|---|---|---|
| 3,088,499 | A * | 5/1963 | Rieger | 141/81 |
| 3,181,957 | A | 5/1965 | Carruthers | |
| 3,386,372 | A * | 6/1968 | Knipp | 100/35 |
| 3,476,037 | A * | 11/1969 | Gorby | 100/223 |
| 3,501,890 | A * | 3/1970 | Hunt | 53/529 |
| 3,563,168 | A * | 2/1971 | Doninger | 100/215 |
| 3,611,673 | A * | 10/1971 | Carkhuff | 53/74 |
| 5,046,304 | A * | 9/1991 | Alameda et al. | 53/570 |
| 5,401,156 | A * | 3/1995 | Anderson | 425/147 |
| 5,987,857 | A * | 11/1999 | Haddow et al. | 53/527 |
| 6,390,330 | B2 * | 5/2002 | Runft | 222/41 |
| 7,051,771 | B2 * | 5/2006 | Ede et al. | 141/71 |
| 7,363,954 | B2 * | 4/2008 | Sleiman et al. | 156/539 |

OTHER PUBLICATIONS

Office Action dated Dec. 17, 2012 in U.S. Appl. No. 13/632,389.
Notice of Allowance dated May 2, 2013 in U.S. Appl. No. 13/632,389.

* cited by examiner

*Primary Examiner* — Timothy L Maust
(74) *Attorney, Agent, or Firm* — Snell & Wilmer L.L.P.

(57) ABSTRACT

A method and apparatus for filling and/or tamping product in a container is disclosed herein. More specifically, the present disclosure is related to a device for filling a container with a material including a conduit comprising a top opening and a bottom opening, and a tamper integrally coupled to the conduit. The tamping face may be configured to move in a straight path along the axis normal to the plane of the bottom opening from the second position to a third position. The shape of the perimeter of the tamping face may be configured to mirror the internal shape of a provided container.

18 Claims, 10 Drawing Sheets

CONTAINER TAMPING SYSTEM

CROSS-REFERENCE TO RELATED APPLICATIONS

The present application claims priority to U.S. Nonprovisional application Ser. No. 13/632,389 entitled "APPARATUS FOR FILLING CONTAINERS" filed concurrently with this application on Oct. 1, 2012. The disclosure of which is incorporated herein by reference in its entirety for any purpose.

FIELD OF INVENTION

This invention relates to a system and apparatus for filling containers, and more particularly, to a system and method directed to a container filler comprising an integral tamper with optimized tamping surface features.

BACKGROUND OF THE INVENTION

Although, in general, the container filling process is known, a number of deficiencies are apparent in the prior art. Most notable of these deficiencies is that the conventional industrial container filling process often results in material spillage. Spillage may be material that is intended be transferred from a first location to a container that does not arrive at its intended destination and/or arrive in the intended positioning. For instance, lettuce leaves delivered through a filler which arrive completely or partially outside of a intended container. As such, use of conventional industrial container fillers often requires downstream personnel to cure cosmetic and functional imperfections resultant from material spillage. Of course, increases of manpower needs, in turn, increase production costs and often slow the rate of production. It would be advantageous to reduce number of additional personnel utilized.

Also, conventional industrial container filler systems often employ downstream tamping systems to depress at least a portion of the material so that a lid may be coupled to the container. In this way, the material does not create an impediment to lid placement. Each downstream additional tamping system increases the overall system footprint. Moreover, each additional piece of machinery caries a cost and a potential for failure. It would be advantageous to reduce the number of these additional downstream mechanical systems.

Often times, material traveling through an industrial container filler may become temporarily caught on a structure within the filler. For instance, lettuce leaves may become adhered to an internal surface of a filler due to a slope of a surface being too flat or surface characteristics of the filler that encourage suction. This results in a production delay as the container filling process is ordinarily paused and steps are taken to remove the caught material and/or accumulated aggregate caught material. This delay increases production costs. It would be advantageous to reduce the number of production delays.

Reduction in distance between the filler bottom and the container minimizes spilling of material outside of the container. Often times if the gap between the container and the filler bottom is too small, material may make contact with the bottom of the filler as the container is advanced on the production line. This often results in spillage of the material which workers must address by hand. It would be advantageous to have a filler system which reduces material spillage.

Moreover, historically, tampers have not been integral to fillers. Optimally, the motion of tamping and/or compression is in a downward direction towards the bottom of a container; however, optimally, the path of a filler is straight down into a container with little impeding the flow of material from a top opening to a bottom opening. As one can appreciate these two goals have been at odds as the tamper can not be positioned directly over the container without impeding the flow of material through a vertical conduit of the filler. Conventional tampers may be been offset and/or configured to tamp in a less than optimal direction, e.g. other than horizontal towards the bottom of a provided container. It would be advantageous to have a filler system which allows for tamping in a direction towards the bottom of the container.

The shape of the tamper may be dependent on the path of motion of the tamping action. For instance, a tamper that approaches the surface of material in a container at an angle other than 90 degrees may comprise a tamping face orientation that is configured in a manner consistent its angle of approach. A goal of tamping is compressing material in a way such that a lid may be coupled to the container without pinching material between a lid to container interface. Thus, tamping in the downward direction, away from a lid to container interface is preferred. It would be advantageous to have a filler system which allows for tamping in a direction towards the bottom of the container.

Moreover, at times material because adhered, such as through suction, to the face of the tamper. This reduces the amount of material that is ultimately deposited into the container and can result in spillage of material outside of a container. For instance, if the material releases from the face of the tamper when a container is not underneath the tamper the material will likely result in spillage onto a conveyer belt and/or into the product filling production floor which is undesirable. It would be advantageous to have a filler system comprising surface features optimized to reduce material becoming adhered to the tamping face.

The present inventors have recognized that filler with integral tamper design would allow a significant increase in productivity with a decrease in system footprint, and production costs, particularly for a process where a container is filled with a material, such as vegetable (e.g. lettuce).

SUMMARY OF THE INVENTION

The present invention relates to an improved container filler and apparatus designed to address, among other things, the aforementioned deficiencies in prior art container filling systems.

While the way in which the present invention addresses these deficiencies and provides these advantages will be discussed in greater detail below, in general, the use of an integral vertical tamping system enables efficient and cost-effective container filling. Furthermore, the use of such a system reduces the need for down-stream personnel and additional downstream tamping machinery, such as downstream vertical tampers, which is advantageous. Moreover, the integral vertical tamping system can self-clear obstructions within portions of its conduit.

A filler may direct material, such as a leafy vegetable, from one location to another, via a conduit. In a preferable embodiment, the filler may direct material from a first location external to a container into a second location within the container.

In accordance with one aspect of an exemplary embodiment of the invention, a container may be filled with material by a filler and then an integral vertical tamper of the integral tamping system may be moved into a position directly above the container without further advancement and/or movement of the container under the filler. This positioning of the tamper location may be in response to the initiation of material being fed, such as gravity-fed, into a container and/or material passing through the filler, such as material passing through the filler directed into a container. Also, this positioning of the tamper location may be in response to material in the container being ready for tamping/compression.

In accordance with one aspect of an exemplary embodiment of the invention, a device for filling a container with a material includes a conduit comprising a top opening and a bottom opening, and a tamper integrally coupled to the conduit. The tamper may be configured to move laterally in a substantially straight path along an axis perpendicular to an axis normal to a plane of the bottom opening at the opening from a first position to a second position. A tamping face of the tamper is configured to move in a substantially straight path along the axis normal to the plane of the bottom opening from the second position to a third position. For instance, the tamping face may be configured to move in a straight path along the axis normal to the plane of the bottom opening from the third position to the second position within at least two substantially parallel interior walls of the conduit. In some embodiments, the third position may be located at least one of (1) outside of a channel interior to the conduit and (2) within a channel interior to the conduit.

In accordance with one aspect of an exemplary embodiment of the invention, a side surface of the tamper may be configured to assist the material traveling from the top opening to the bottom opening in response to the tamper being in the first position. Stated another way, an interior surface of the conduit may comprise a tamper side surface, which is integral to the tamper, where the face of the tamper side surface is oriented orthogonal to the tamping face.

Moreover, the conduit may include angled surface features configured to assist the material traveling from the top opening to the bottom opening. In various embodiments, a tamper side surface is configured to mirror a respective edge of the bottom opening of the system. Thus, in operation, the bottom opening edge of the system will not impede operation of the tamper. The tamper face is configured to move through the bottom opening and at least partially through the conduit from the second position to the third position, such as from a compressed orientation to an extended orientation. The tamper face is configured to make contact with the material as the tamping face moves from the second position to the third position through the bottom opening of the system. Also, if warranted, the tamping face is configured clear material from the conduit as the tamping face moves from the second position to the third position.

In various embodiments, to reduce spillage, a shape of the bottom opening may be configured to mirror a shape of an opening of a container.

These and other features and advantages of the present invention will become apparent to those skilled in the art upon a reading of the following detailed description when taken in conjunction with the drawing figures, wherein there is shown and described various illustrative embodiments of the invention.

BRIEF DESCRIPTION OF THE DRAWING FIGURES

The subject matter of the present invention is particularly pointed out and distinctly claimed in the concluding portion of the specification. A more complete understanding of the present invention, however, may best be obtained by referring to the detailed description and to the claims when considered in connection with the drawing figures, wherein like numerals denote like elements and wherein:

DETAILED DESCRIPTION

The present invention provides for significant advancements over prior art processes, particularly with regard to process efficiency, process economics, and reduction of material arriving in an unintended positioning. Moreover, existing tray filling systems may, in many instances, may easily be retrofitted to exploit the many commercial benefits the present invention provides. The present system reduces spilling of material outside of the container. Additionally, though down-stream tampers may be used with the present system, they are not likely to be implemented as the present system can perform their function. For instance, use of the present system results in a filled container ready to receive a lid. These and other exemplary aspects of the present invention are discussed in greater detail herein below.

Figure 1A:
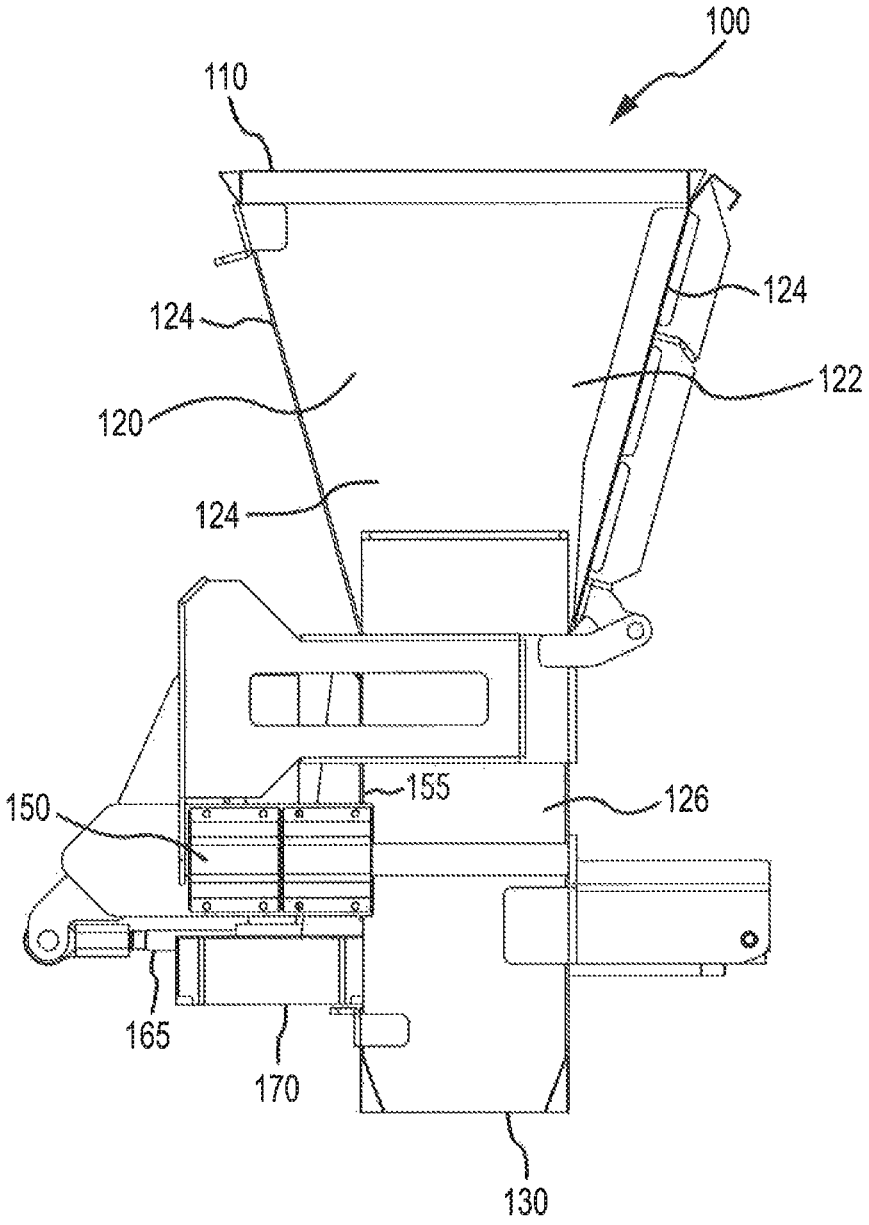
FIG. 1A illustrates a profile view of an integral vertical tamping system in accordance with one embodiment of the present invention.
Figure 1B:
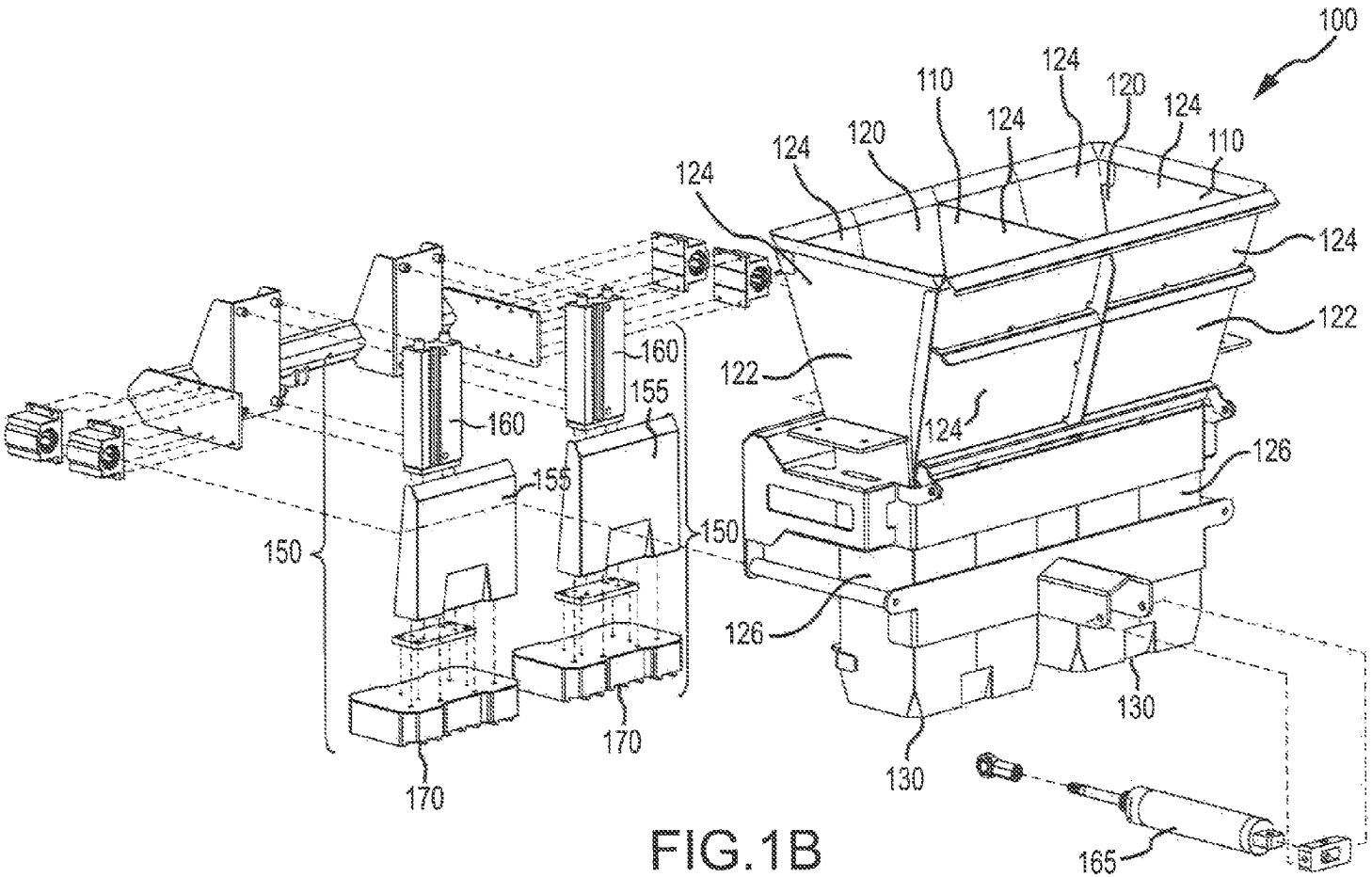
FIG. 1B illustrates an exploded perspective view of the integral vertical tamping system of FIG. 1A in accordance with one embodiment of the present invention.

With initial reference to FIGS. 1A-1B, an integral vertical tamping system 100 illustrating various aspects of an exemplary embodiment of the invention is provided. Integral vertical tamping system 100 generally comprises a top opening 110 for receiving material 102 (e.g. product), a conduit 120 configured to direct material 102 to a desired location, and a bottom opening 130 for delivering material 102 to the desired location. Integral vertical tamping system 100 also comprises an integral tamper 150. Material 102 may be any type of material, such as an edible material. For instance, material 102 may be a fruit or vegetable, such as lettuce, spinach, spring mix, figs, dates, nuts and/or the like.

In various embodiments, top opening 110 is coupled integrally to conduit 120. Top opening 110 may be any suitable shape, such as rectangular, square, rounded, ovoid and/or the like. Top opening 110 may comprise a rectangular cross section. Top opening 110 may be formed by the edges of the interior walls of conduit 120. For instance, top opening 110 may be formed by the interconnection of two sets of interior walls of conduit 120. In various embodiments, the meeting of the edges of the interior walls may be rounded to reduce material 102 becoming trapped or caught in the corners.

Conduit 120 may comprise a chute connecting top opening 110 to bottom opening 130. Conduit 120 may comprise a top portion 122 and a bottom portion 126. Conduit 120 may be any suitable shape. Conduit 120 may be made from any suitable material. Conduit 120 may be made from a durable material which may be cleaned and sanitized with ease. For instance, conduit 120 may be formed from stainless steel. Also, conduit 120 may be made from a material configured to reduce material 102 dragging, such as via suction on its interior side walls. For instance, portions of conduit 120 may be made from a rigidized metal, such as welded rigidized metal configured in a pattern, such as a 7DL pattern.

In accordance with one aspect of the invention, with further reference to FIGS. 1A-1B, conduit top portion 122 may comprise a rectangular cross section along a horizontal cut-plane. Through any combination of parallel and/or angled side walls are contemplated for each interior wall, in an exemplary embodiment, conduit top portion 122 may comprise three angled side walls 124 that are angled outward and one wall with an angle of about 90 degrees from the horizontal. Thus, conduit top portion 122 may taper from wide at top opening 110 to narrow where conduit top portion 122 meets conduit bottom portion 126. The angle of each of angled side walls 124 may be between 90 degrees and 45 degrees from a horizontal plane. For instance, the side walls 124 may be angled between about 85 and 55 degrees, more preferably on the order of about 80 and 60 degrees and most preferably about 70 and 60 degrees. An angle closer to 90 degrees, such as between about 70 and 90 aids in delivering gravity fed material 102 thought conduit 120. The angles of each angled side wall 124 may be independent of other angled side walls 124 of conduit 120. The angles of each angled side wall 124 may be the same as any other angled side wall 124 of conduit 120. The top of conduit top portion 122 is top opening 110.

With renewed reference to FIGS. 1A-1B, in accordance with one aspect of the invention, though it could be any suitable shape, conduit bottom portion 126 may comprise a rectangular cross section. In an exemplary embodiment, conduit bottom portion 126 may comprise two sets of substantially parallel walls 126. In an exemplary embodiment, not shown, conduit bottom portion 126 may comprise one or more angled side walls. In an exemplary embodiment, also not shown, conduit top portion 122 may extend from top opening 110 to bottom opening 130 thereby effectively obviating conduit bottom portion 126. In an exemplary embodiment, at least a portion of at least one of parallel wall 126 may comprise a side face 155 of integral tamper 150. The bottom of conduit bottom portion 126 is bottom opening 130.

In an exemplary embodiment, conduit bottom portion 126 is permanently coupled to conduit top portion 122. In an exemplary embodiment, conduit bottom portion 126 may be removed from system 100 and replaced with a second conduit bottom portion 126 with larger or smaller dimensions suitably shaped to correspond with the shape and dimensions of a provided container.

In an exemplary embodiment, conduit bottom portion 126 may be configured to receive a semi-permanent adapter suitably shaped to correspond with the shape and dimensions of a provided container. This adapter may reduce the size of conduit bottom portion 126 to a smaller shape or modify the shape of conduit bottom portion 126 to substantially mirror the respective shape of a provided container.

Bottom opening 130, may comprise any suitable shape. For instance, in an exemplary embodiment, bottom opening 130 may be shaped to mirror the shape of an opening of a container. Bottom opening 130 may be suitably shaped such that its outer surface is slightly smaller than, matches or is slightly larger than the opening of a container.

In accordance with one aspect of the invention and with reference to FIG. 1B, a tamping unit such as integral tamper 150 may comprise a tamper housing 160, a tamping face 170 and a tamping piston 180. Also, integral tamper 150 may be coupled to a housing piston 165 for moving tamper housing 160. Though this motion may be in any suitable direction, preferably, this movement is in the horizontal direction along a substantially horizontal plane. As noted above, portions of integral tamper 150, such as side face 155, may comprise portions of conduit 120. Tamping face 170 may be configured for making contact with, compacting and/or compressing material 102 delivered to a container.

Tamper housing 160 may comprise circuitry and/or a controller for operating tamper 150. Tamper 150 may be configured such that tamping face 170 may be compressed and extended from tamper housing 160. For instance, tamper housing 160 may be coupled to tamping piston 180. Tamping piston 180 may be coupled to tamping face 170. In response to a received signal, tamping face 170 may be extended from a compressed first position to an extended position or a partially extended position via operation of tamping piston 180. Thus, tamping face 170 will move from a position near tamper housing 160 to a position away from tamper housing 160 depending on the length, stroke, and operation of tamping piston 180. Tamping piston 180 may be a mechanical actuator, such as hydraulic cylinder with mechanical, electronic, fluid and/or pneumatic operation. The controller may control the force, speed, distance, and/or acceleration of tamping piston 180. These variables may be controlled in response to material 102 being delivered by integral vertical tamping system 100. Thus, tamping face 170 may be programed to travel deeper into a container or with greater force based on the type of material 102 being tamped.

Also, in an exemplary embodiment, tamping face 170 may optionally be programed to clear debris from the interior walls of conduit 120 but not make contact with material 102 delivered to the container. In this embodiment, tamping face 170 may be retrofitted with an adapter configured to clear material 102 from conduit 120. This functionality may be programed to occur on a periodic basis such as after each container is filled or after a set number of containers are filled or be called upon on an ad hoc basis, such as initiated by a user. Optionally, the operation of tamper 150 may be temporarily disabled.

Though a piston is depicted and described, it is understood that any modality of moving tamping face 170 from a compressed position to an extended position in a substantially vertical plane may be utilized. For instance, tamping face 170 may be pulled, dropped and/or pushed into position (from a compressed position to an extended position and/or vice versa). This movement may be accomplished via mechanical, fluid, electrical, pneumatic, and/or magnetic operation. The compressed position refers to tamping face 170 which is not extended from tamper housing 160 by tamping piston 180.

As mentioned above, in accordance with one aspect of the invention, tamper housing 160 may be coupled to housing piston 165. Housing piston 165 may be coupled to integral vertical tamping system 100. Housing piston 165 may be a mechanical actuator, such as hydraulic cylinder with mechanical, electronic, fluid, or pneumatic operation. Housing piston 165 may comprise and or be coupled to circuitry and/or a controller for operation. Housing piston 165 may move tamper housing 160 from a first position to a second position and vice versa. In general, this movement is along a horizontal plane. Housing piston 165 and/or tamper housing 160 may run along one or more track external to the interior of conduit 120. Thus, in practice, tamping face 170 along with tamper housing 160 (in a compressed orientation) move from a first position to a second position along a horizontal plane. Then, tamping face 170 moves from its compressed orientation to an extended orientation in a substantially vertical plane.

The controller may control the timing of movement, speed, and/or range of movement of housing piston 165. These variables may be controlled in response to material 102 being delivered by integral vertical tamping system 100. Thus, tamping face 170 may be programed to travel deeper or shallower into a container or with greater or less force based on the type of material 102 being tamped. Optionally, the operation of the housing piston 165 may be temporarily disabled. In this way, material 102 may be filled by integral vertical tamping system 100 without tamping. Thus, there is no delay for moving tamping housing 160 from the first position to the second position and back between material 102 being filled into each newly indexed container.

Though a piston is depicted and described, it is understood that any modality of moving tamper 150 and tamper housing 160 from the first position to the second position, such as in the substantially horizontal plane, may be utilized. For instance, tamper 150 and tamper housing 160 may be pulled, pushed, dropped, lifted, or rotated into position from the first position to the second position. This movement may be accomplished via mechanical, electrical, pneumatic, fluid and/or magnetic operation. This tamper 150 operation and movement will be described in greater detail below.

Figure 2A:
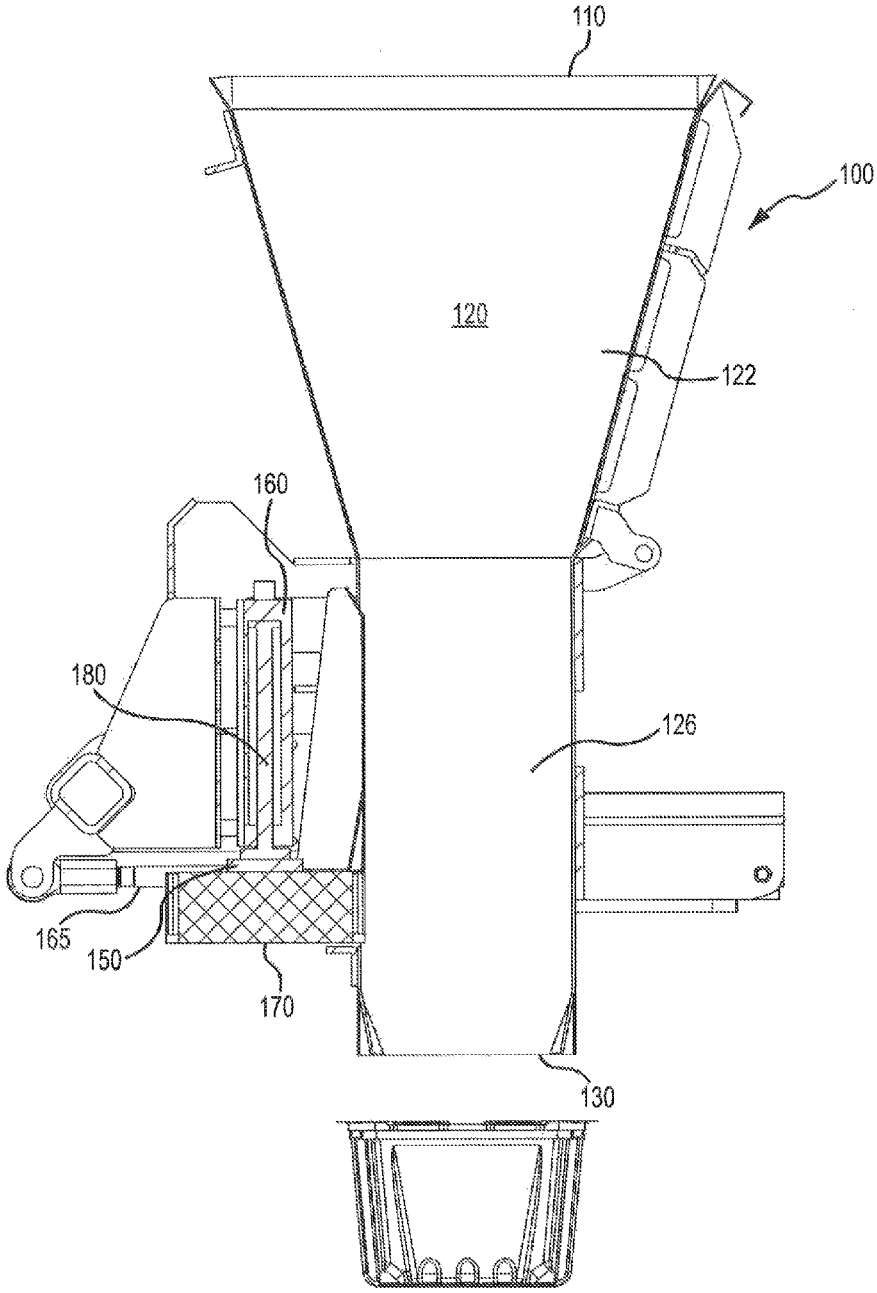
FIG. 2A illustrates a profile view of the integral vertical tamping system of FIGS. 1A and 1B in accordance with one embodiment of the present invention where the integral tamper is compressed is in a first position.

In accordance with one aspect of the invention, coupled to tamping face 170 (or a portion of tamper housing 160) is tamper 150 side face 155. When tamper housing 160 and tamping face 170 is in a first position, the exterior of side face 155 may comprise a portion of an interior wall of conduit 120. With reference to FIGS. 2C-2E, conduit 120 may be shaped, such as with a cut-out to receive side face 155, so that the adjacent interior walls of conduit 120 are generally even with side face 155. Also, the orientation of side face 155 may be configured such that there are minimal gaps between the edges of side face 155 and the cut-out edges of conduit 120. Aspects of side face 155 may be shaped relative to a provided container and/or surface features of the interior conduit 120 wall opposite side face 155. For instance, side face 155 may be shaped to mirror an indentation or notch in conduit 120 wall opposite side face 155. Also, side face 155 may be shaped such that surface features of the wall opposite side face 155 do not impede the extension of the tamper 150. Side face 155 may be made of any suitable material and/or combination of materials. For instance, the upper portion of side face 155 may be made from rigidized metal such as rigidized metal configured in a pattern, such as a 7DL pattern, and the lower portion of side face 155 may be made from a molded plastic.

Figure 3A:
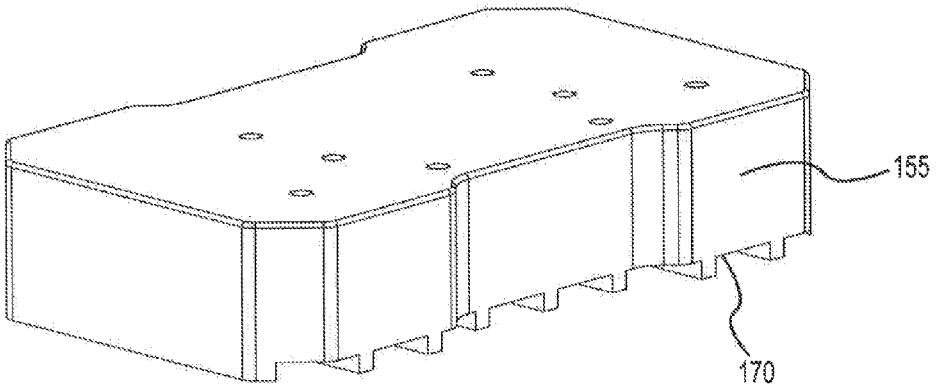
FIGS. 3A-3B illustrates views of a tamper face in accordance with one embodiment of the present invention.
Figure 3B:
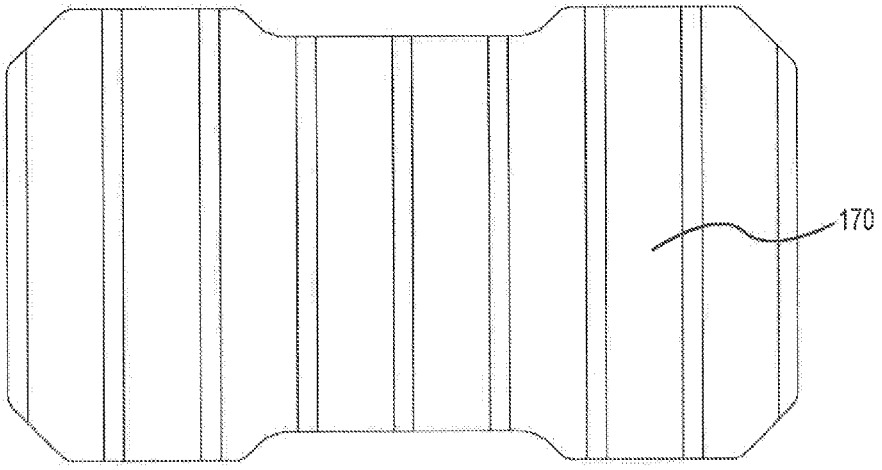
Figure 4:
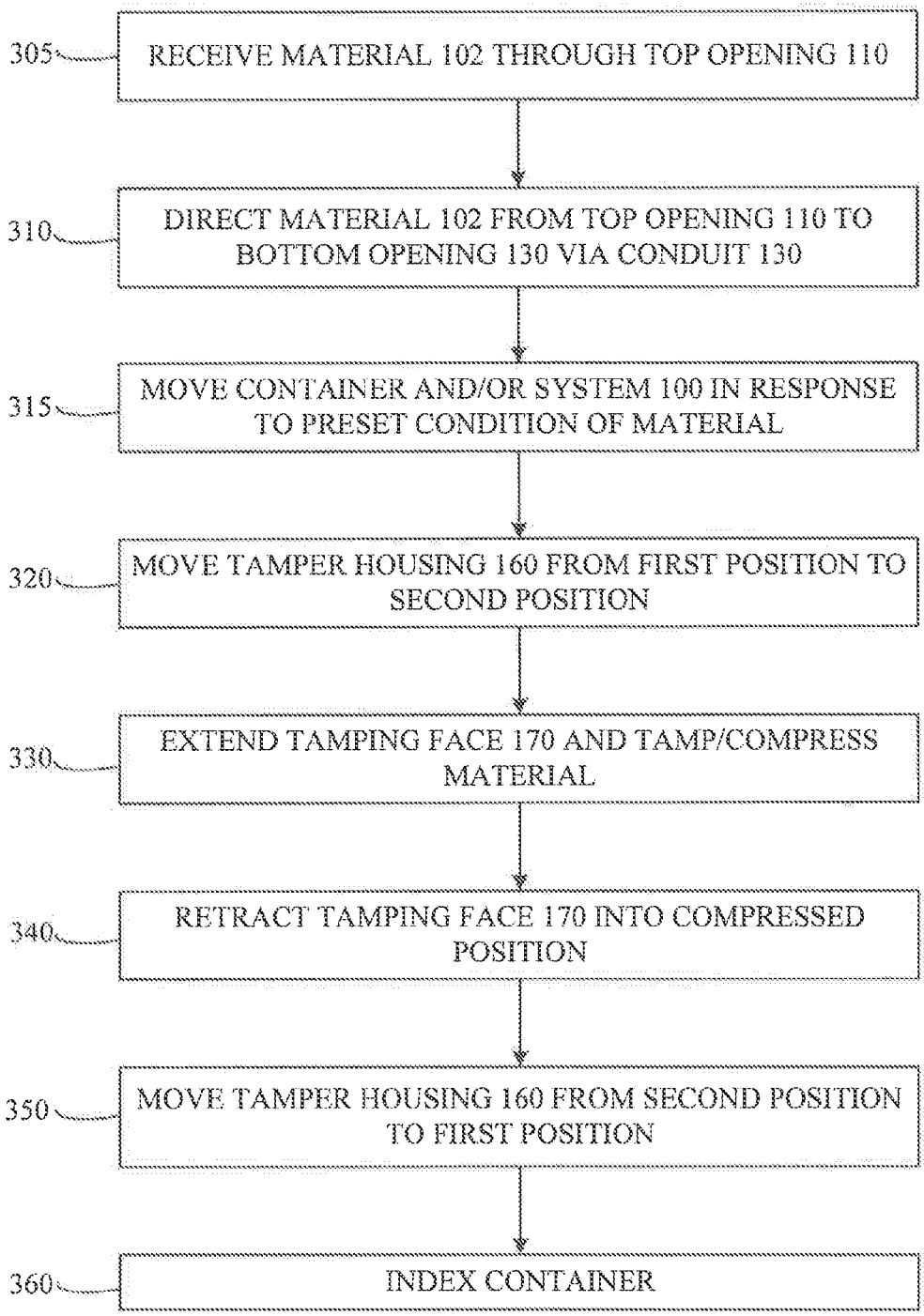
FIG. 4 illustrates a flow chart of an exemplary embodiment the operation of the system.

In accordance with various embodiments, and with reference to FIGS. 3A and 3B, tamping face 170 may comprise surface features for reducing material 102 from sticking to, such as temporarily sticking to, tamping face 170. These surface features may be any suitable surface features. For instance, in an embodiment, the surface features comprise a non-flat surface. This non-flat surface may comprise a raised portion, a lowered portion and/or combinations thereof. These raised and/or lower portions may be arranged in a repeating pattern and/or they may be implemented in a pseudo random or random pattern. The raised and lowered portions may be in any shape such as in a grid, a ridge, a valley, honey comb, a zig-zag pattern, wavy, random, and/or combinations thereof.

These surface features may be optimized based on the material 102 being tamped and/or based on the condition of the material 102 being tamped. For instance, if a leafy material 102 a leaf having a small footprint is desired to be compressed, a surface feature with small gaps between raised portions and lowered portions may be desired. In this way, the leaves are less likely to be trapped between elements of the surface features.

In accordance with various embodiments, at least one side surface of tamper face 170 may be configured to mirror an edge of bottom opening 130. In this way, as tamper face passes through bottom opening, traveling from a compressed orientation to an extended orientation, bottom opening 130 will not impede the motion of tamping face 170. Moreover, as the gap between an interior side wall and a side surface of tamping face 170 is reduced the easier tamping face 170 will be able to clear material 102 from the interior of the conduit 120.

Tamper face 170, may comprise a thickness. This thickness may be any suitable thickness. In various embodiments, tamper face 170 may be coupled to tamper housing 160 and operated via tamper piston 180. This coupling may be by any suitable coupling method. Moreover, in various embodiments, tamper face 170 may removably coupled to tamper housing 160 such that it may be swapped with a replacement tamper face 170 and/or replaced with a tamper face 170 having different surface properties and/or tamper face 170 dimensions. Thus, for instance, if a container comprising an interior side surface with an indentation was desired to be filled, a tamping face 170 comprising a protrusion to mirror the indentation of the interior surface may be coupled to the filling and tamping system 100.

In various embodiments, tamping unit and/or portions of tamping unit, such as tamping face 170, may be those which are likely to wear out sooner than other elements of vertical tamping system 100. Thus, replacement tamping face 170 members are envisioned.

For instance, with renewed reference to FIGS. 3A-3B, a tamping face 170 is depicted. In accordance with various embodiments, this tamping face 170 may comprise a side surface 155 comprising an indentation to mirror the shape of a side of bottom opening 130. In this case, an interior side surface of the container may have a protrusion. As the shape of bottom opening 130 is shaped to mirror an interior side surface of a container, so to is the side surface 155 shaped to mirror the interior side surface of the container. As other conventional tampers are not configured with an integral tamper 150 that operates in the vertical direction, this shape, that mirrors the interior dimensions of a container was not possible to be achieved. A downward tamping motion with a tamper 150 shaped to mirror the interior shape of a container results in very little to no material 102 spillage out of the container. Moreover, to the extent that the clearance between the top of the container to 130 bottom opening is minimized and/or approaches or is zero, opportunities for spillage outside of the container are reduced and/or eliminated.

Also, in a preferred embodiment, the distance between a side surface 155 and the interior side surface of a container is minimized. For instance, in various embodiments this distance between a side surface 155 and the interior side surface of a container is between about one eighth of an inch and 1 inch, or more preferably between 1 quarter inch and 3 quarter inches, and most preferably between 1 quarter of an inch and eight of an inch.

Given the direction of stroke of the tamper piston, the material 102 is compressed down toward the bottom of the container. This compression is in a direction away from the opening of the container. Moreover, in various embodiments, this tamping force substantially even across the surface of the material in the container. In other tamping systems, the direction of the tamping is in a direction which is not in a straight path down towards the bottom of the container. For instance, tampers with a rolling motion or an angled motion compress material down and toward the sides of the container and/or at an angle. In some cases, these tampers create a mounding effect pushing material away from the center and up the sides of the container. This can result in material getting stuck in the lid or being pushed out of the container. Reducing this spillage is desired.

Tamping face 170 is depicted as being made from a molded polymer, such as a molded plastic however any suitable material and/or combination of materials may be used to create tamping face 170.

In accordance with various embodiments, side face 155 of tamper 150 may not comprise a portion of conduit 120. In this embodiment, tamper 150 moves into and/or is oriented in the second position over the container for tamping from a first position where it does not impede material traveling through the conduit to the container.

In accordance with one aspect of the invention and with reference to FIGS. 3A-3B, tamping face 170 may have any suitable shape. In an exemplary embodiment, tamping face 170 may comprise a generally rectangular cross section. The edges of tamping face 170 may be shaped to mirror the interior walls of conduit bottom portion 126. In an exemplary embodiment, tamping face 170 may be shaped to mirror the shape of an opening of and/or interior shape of a provided container. Tamping face 170 may be shaped to mirror the interior walls of conduit bottom portion 126. In an exemplary embodiment, tamping face 170 may comprise surface features designed to reduce material 102 sticking to elements of tamper 150. Tamping face 170 may be configured to make contact with and/or compress material 102. Tamping face 170 and portions of tamper 150 may be made from any suitable material, such as a polymer. For instance, for ease of construction and/or to aid with sanitation, tamping face 170 may be made from molded plastic. Tamping face 170 and/or tamper 150 elements may be coupled to tamping piston 180 by any known coupling means. For instance, tamping face 170 may be coupled to tamping piston 180 by bolt. In this way, tamping face 170 may comprise female threading to receive machine bolts fed through and/or coupled to tamping piston 180. Thus, tamping face 170 may be conveniently removed for repair, replacement or swapped with a tamping face 170 comprising alternative properties, such as made from a different material, made with different surface properties, and/or made with a different shape, for instance to correspond to a different provided container.

In various embodiments, with renewed reference to FIGS. 1A-1B, the aforementioned elements of integral vertical tamping system 100 may be duplicated, presenting an integral vertical tamping system 100 with a pair of conduits 120 coupled side-by-side both having integral tampers 150. These systems may be fed with material 102 by a system, such as a filler box, configured to toggle between or systems configured to independently deliver material 102 to each respective top opening 110. The integral tampers 150 of the respective conduits 120 may be configured to operate in tandem, as depicted, or they may be configured to operate independently of each other with individual housing pistons 165 coupled to each respective tamper housing 160.

In accordance with one aspect of the invention and with reference to FIGS. 2A-2D and FIG. 4, in operation, an apparatus or system, such as a filler box, hopper and/or filling system, comprising material 102, may deliver the material 102 vertical tamping system 100 (step 300). Though this delivery may be accomplished in any suitable fashion, most preferably the filling system is oriented substantially above integral vertical tamping system 100 and drops the material 102 into tamping system 100 through top opening 110. This material 102 may be weighed in the filler box or prior to being held by the filling system. In various embodiments, the filler box may toggle between each top opening 110 of the tamping system 100 and angle its delivery of material 102 to each conduit 120 of integral vertical tamping system 100.

Integral vertical tamping system 100 receives material 102 through top opening 110 (step 305). Material 102 is then directed towards bottom portion 126 of conduit 120 (step 310). For instance, using the angled surface features, such as angled side walls 124, of top portion 122 of conduit 120, material 102 is directed towards bottom portion 126 of conduit 120.

In an exemplary embodiment, material 102 is dropped in response to a timing scheme, programing and/or sensors indicating a container is positioned to receive material 102 substantially under integral vertical tamping system 100 through top opening 110 and/or being ready to be dropped through top opening 110 into integral vertical tamping system 100, and/or the container is moved into position. In various embodiments, positioned to receive material 102 may refer to the opening of the container being substantially in line with bottom opening 130.

In an exemplary embodiment, in response to programing and/or sensors indicating material 102 is ready to be, is being and/or has been dropped, a container is positioned to receive material 102 substantially under integral vertical tamping system 100 (step 315). In accordance with one aspect of the invention and with reference to FIG. 2B, the integral vertical tamping system 100 may be automatically and/or manually moved up or down with respect to a container, the container may be automatically and/or manually mechanically moved up to, around, or in a portion of integral vertical tamping system 100 and/or the container may be automatically and/or manually positioned under integral vertical tamping system 100 such as by advancement of a conveyer belt. Also, the conveyer belt may be configured to automatically and/or manually move up or down, as desired.

Material 102 passes through conduit 120 and is delivered to bottom opening 130. Integral vertical tamping system 100 is configured to direct material 102 through bottom opening 130 into an awaiting container. To aid with advancing the container (e.g. so that material 102 delivered by integral vertical tamping system 100 in the container does not make unintended contact with a surface or an edge of integral vertical tamping system 100) and/or placing a lid on the container, material 102 in the container is compressed via tamper 150.

In an exemplary embodiment, in response to material 102, such as a leafy vegetable, being dropped through conduit 120, housing piston 165 is provided a signal to move tamper housing 160 from the first position to a second position (step 320). The movement of housing piston 165 may be triggered by programming, sensor or electronic notification. For instance, the timing of the duration of material dropping from a filler box to bottom opening 130 may be known, calculated or observed. Based on this timing, the conduit is ready to receive tamper 150 and may be obstructed (by tamper 150) as material 102 has already passed through. Stated another way, the first position of tamper 150 is generally outside of the path of material 102 dropping within conduit 120, this position may be outside of conduit 120. When tamper 150 is in the second position, it is generally in a vertical line with the container, preferably over the container opening. Tamper 150 may travel in any path from the first position to the second position, however, as the time tamper takes to arrive at the second position will effect productivity, a short travel path is generally preferred.

Different material 102 and/or conditions of the material 102, (e.g. dry or wet) may affect drop times. The operation the system 100, such as a the operation of a conveyer belt indexing containers, housing piston 165, and the like, may be calibrated based on these drop times. As stated above, in various embodiments, the motion of tamper housing 160 is generally in a short path of travel, more preferably, generally along a horizontal plane. Preferably, when housing piston 165 is in the first position, the tamper housing 160 is out of the path of material 102 traveling through conduit 120, such as exterior to conduit 120. Thus, the tamping face 170 and tamper housing 160 do not impede material 102 passing through conduit 120 when housing piston 165 is in the first position. In various embodiments, not depicted, tamper 150 may be interior to the conduit 120 so long as its placement and/or features of the conduit allow for material 102 to travel to container without being impleaded by tamper 150.

With renewed reference to FIGS. 2C and 2D, preferably, in accordance with the various aspects of the present invention, material 102 in the container (not shown) is suitably compressed through operation of tamping system 100.

In general, tamping unit, comprising tamping face 170, is moved from a first position, such as a first position outside an opening in the conduit 150, to a second position generally covering the opening of the container and then to a third position. Preferably, movement of the tamping face 170 from the second position to the third position suitably compresses the material such that further efforts to compress the material or attend to spillage are unnecessary.

In a typical embodiment, where material 102 comprises leafy material, tamping face 170, and container are suitably moved such that tamping face 170 is within about ½ to about 3 inches from the bottom of the container, more preferably on the order of about 1 to about 2 inches and most preferably about 1.5 inches from the bottom. However, the desired distance may be suitably selected based on a number of factors, including, without limitation the type of material 102, the volume of the container, shape of the container, the condition of material 102, durability of material 102, and/or desired compression of the material within the container.

In accordance with an embodiment, in response to tamper housing 160 arriving at the second position, a signal is sent to tamping piston 180 to move tamping face 170 from a compressed position to an extended position (step 330). Though this may be in any suitable path, preferably, this motion is generally along a vertical plane. As tamping face 170 is extended, such as extended away from tamper housing 160, tamping face 170 makes contact with material 102. The stroke of tamping piston 180 may be its full range of motion or less than the full range of motion of tamping piston 180. For instance, tamping face 170 is extended between about 4 and 10 inches, more preferably on the order of about 5 to about 8 inches and most preferably about 6 inches. An extended tamper may result in tamping face 170 being about 1.5 inches from the base of the interior of the container. The preferable stroke distance is a balancing between a short stroke for efficiency against clearing/not making contact with a non-compressed (e.g. fluffed up) mound of material 102 in the container extending up into conduit 120 while tamper 150 moving horizontally. Additionally, as tamping face 170 is extended, tamping face 170 may clear material 102 stuck to and/or hung up in the interior of conduit 120. Thus, as tamping face 170 is extended, tamping face 170 is configured to move within at least two interior walls of conduit 120. In accordance with an exemplary embodiment and with reference to FIGS. 2D and 2E, tamping face 170 may be configured to pass through bottom opening 130 and down into the container to compress material 102 within the container as tamping face 170 moves from the compressed position to the extended position (e.g. from the second position to a third position). In a preferred embodiment, the container does not move while the tamper 150 moves from the first position to the second position and/or while the tamper 150 moves from the second position to a third position.

With renewed reference to FIG. 2C, tamping face 170 may be moved from the extended position to the compressed position (step 340). This motion may be along any path. For instance, in accordance with one aspect of the invention, in response to tamping face 170 arriving at the extended position, a signal is sent to tamping piston 180 to move tamping face 170 from the extended position to the compressed position (step 340). Again, this motion is generally along a vertical plane. In accordance with an exemplary embodiment, tamping face 170 may pass through bottom opening 130 while moving from the second extended position to the first compressed position.

Optionally, a signal may be sent to tamping piston 180 to extend tamping face 170 down conduit 120 a second time, such as to clear material 102 from conduit 120 or to further compress material 102 in the container. This movement may be less than the total range of motion of tamping piston 180, for instance to clear material in conduit 120. As above, a signal may be sent to tamping piston 180 to move tamping face 170 from the extended position to the compressed position. For instance, in response to tamping face 170 arriving at the desired extended position, a signal is sent to tamping piston 180 to move tamping face 170 from the desired extended position to the compressed position.

Figure 2B:
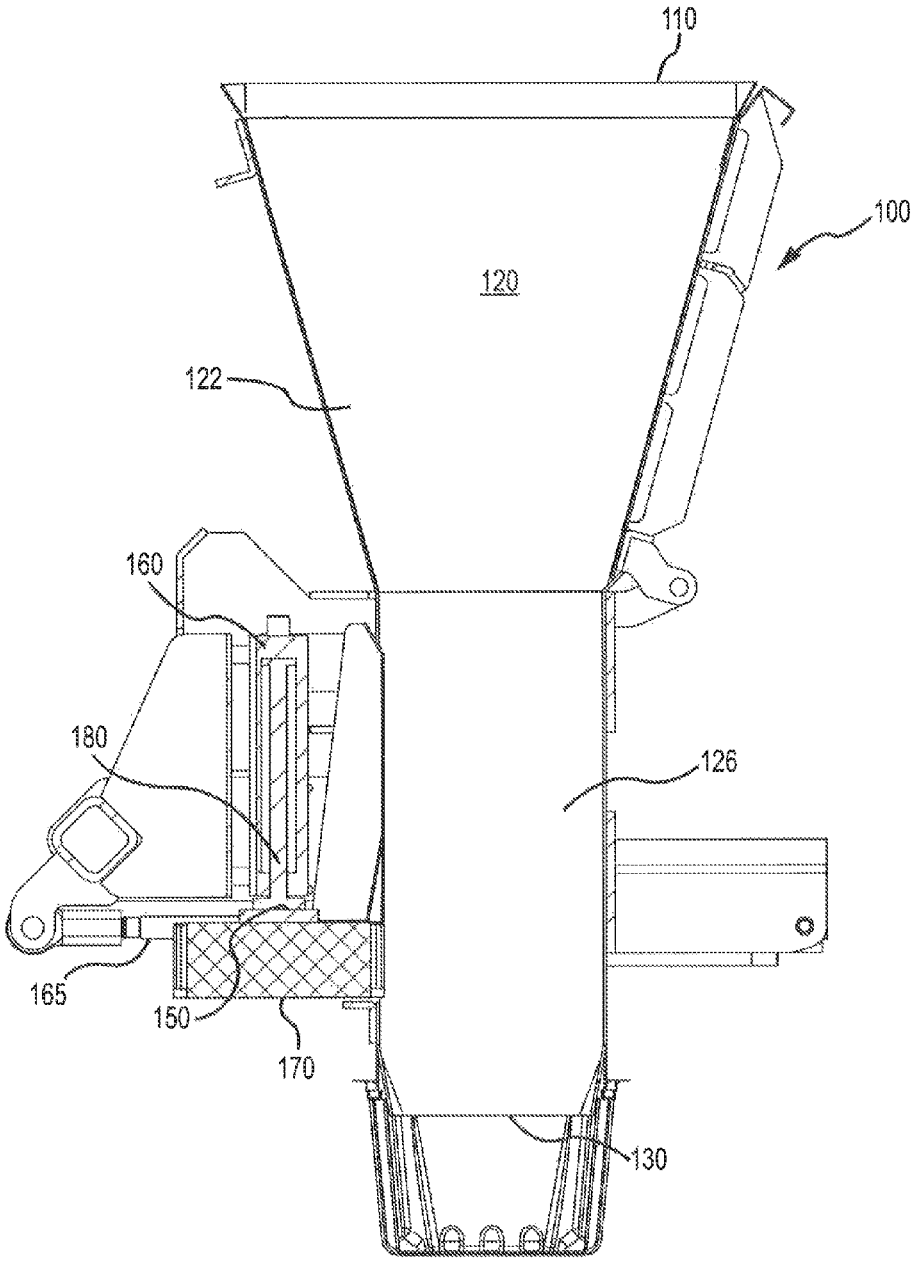
FIG. 2B illustrates a profile view of the integral vertical tamping system of FIGS. 1A and 1B in accordance with one embodiment of the present invention where the integral tamper is compressed is in a first position.
Figure 2C:
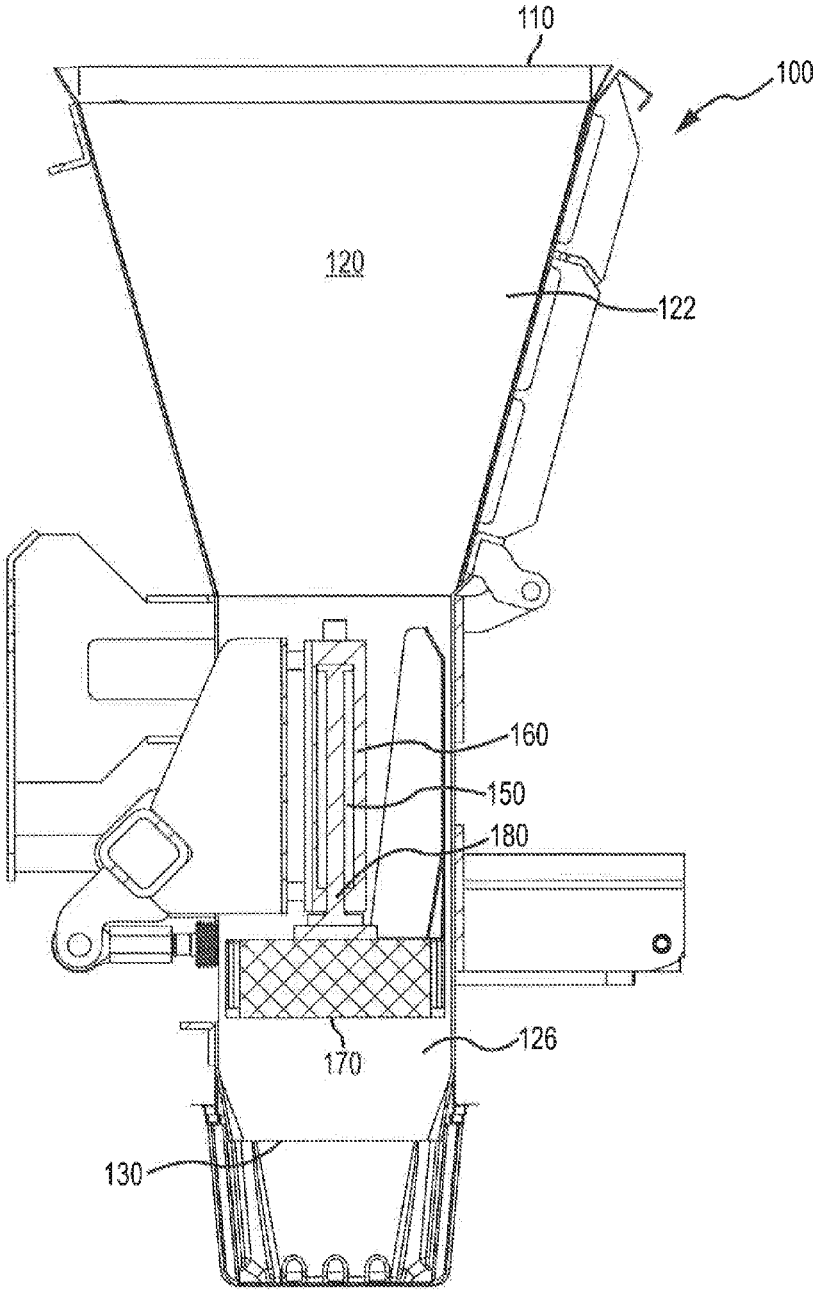
FIG. 2C illustrates a profile view of the integral vertical tamping system of FIGS. 1A and 1B in accordance with one embodiment of the present invention where the integral tamper is compressed in a second position.
Figure 2D:
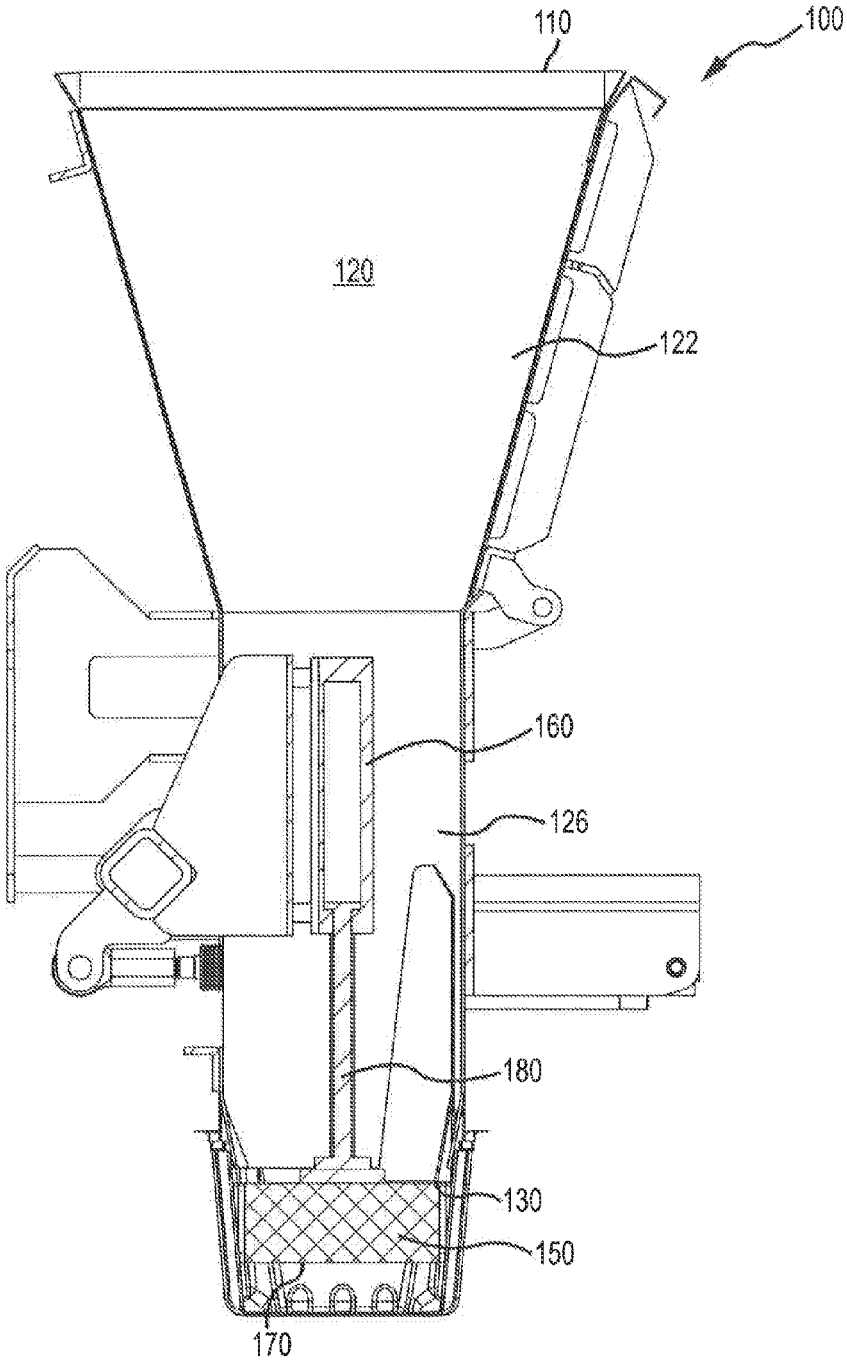
FIG. 2D illustrates a profile view of the integral vertical tamping system of FIGS. 1A and 1B in accordance with one embodiment of the present invention where the integral tamper is expended in a second position.
Figure 2E:
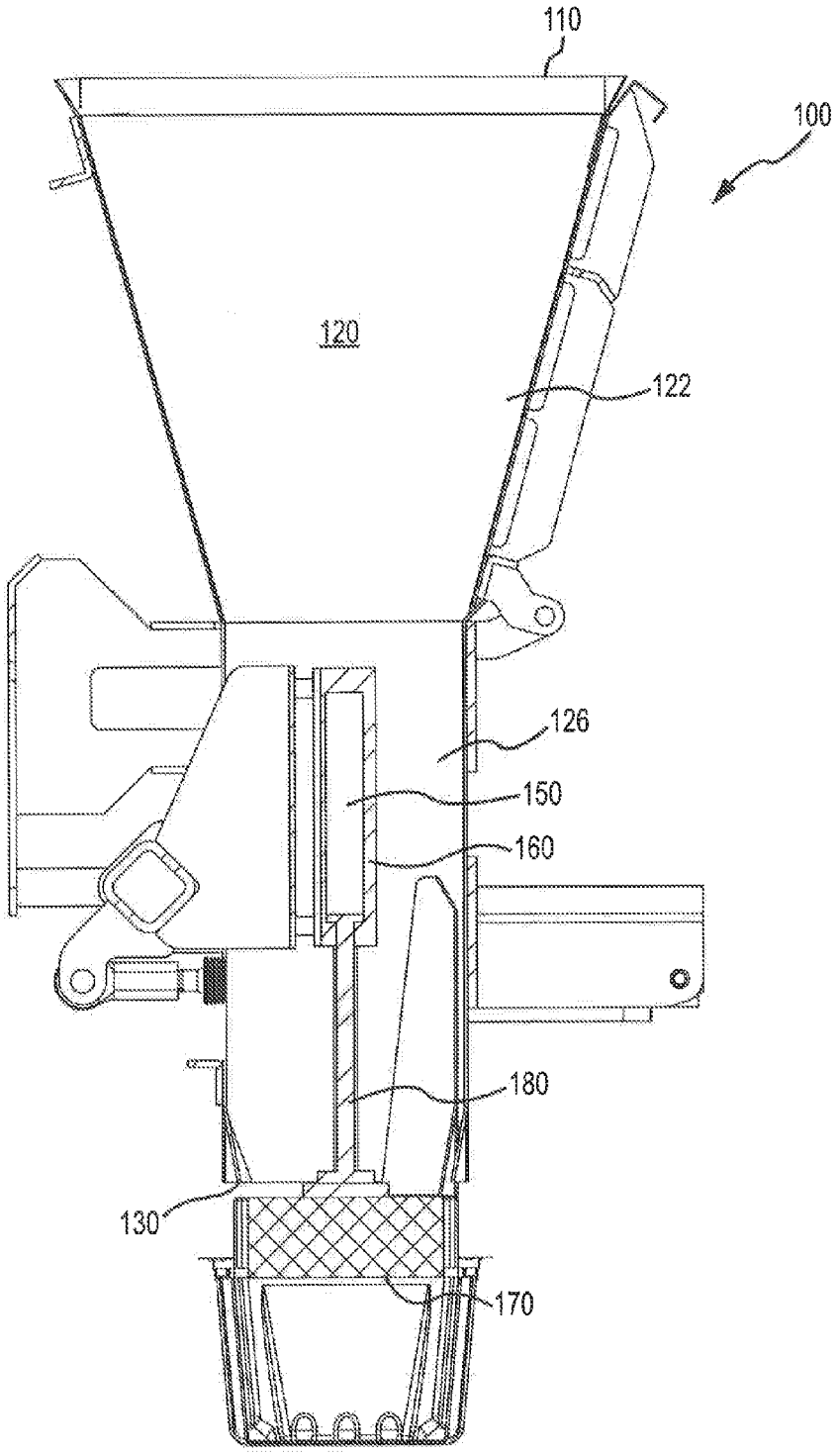
FIG. 2E illustrates a perspective view of the integral vertical tamping system of FIGS. 1A and 1B in accordance with one embodiment of the present invention where the integral tamper is partially expended in a second position.

With renewed reference to FIG. 2B, tamper housing 160 may be moved from the second position to the first position (step 350). For instance, in response to tamper housing 160 arriving at the second position with tamper face 170 in the compressed orientation, a signal may be sent to housing piston 165 to move tamper housing 160 from the second position to the first position (step 350).

With renewed reference to FIG. 2A, in response to material 102 being compressed in the container and/or tamping face 170 being compressed and/or removed from the container, a signal may be sent to a system responsible for advancing the container to advance the container and place a new empty container or container to be filled with material 102, in position for receiving material 102 by integral vertical tamping system 100 (step 360).

Integral vertical tamping system 100 is well suited for larger and/or heavy loads of material 102 in larger containers. The preferable downward/vertical stroke of the tamper 150 is preferable for these large containers as compared with historical angled tamping approaches. For instance, a large container may be a container suitably sized to hold between about 3 ounces and 5 pounds of material 102, more preferably on the order of about 5 ounces to 1 pound. According to various embodiments, a large container may be a container suitably sized to hold about 5 ounces or about 1 pound. Additionally, larger and/or heavy loads generally take longer to fill the container and are well suited to the horizontal and then vertical tamping motion of the tamper housing 160 and tamper face 170 described above.

One or more controllers may be coupled to integral vertical tamping system 100 configured to control the operation of the moving systems and/or parts. For instance, the timing and coordination of the filler box opening, the indexing of the container, the movement of tamping piston 180 and/or housing piston 165 may be controlled by the controller. These controllers may be preprogrammed and/or controlled by a user via a user interface. For instance, the programing of the system may be stored to a non-transitory computer readable medium and/or memory.

In an exemplary embodiment, more than one tamper may be integrally coupled to each conduit 120. For instance, two tampers from alternating opposite sides may be moved from a first position external to the interior of the conduit to a second position substantially interior to conduit 120 along a substantially horizontal plane.

In an exemplary embodiment, a tamper may be located within conduit 120 but due to surface features and/or mechanical aspects of conduit 120 not impact delivery of material 102 to the container. In various embodiments, this tamper 150 may not require the tamper housing being moved from a first position to a second position.

The present invention has been described above with reference to a number of exemplary embodiments and examples. It should be appreciated that the particular embodiments shown and described herein are illustrative of the invention and its best mode and are not intended to limit in any way the scope of the invention as set forth in the claims. Those skilled in the art having read this disclosure will recognize that changes and modifications may be made to the exemplary embodiments without departing from the scope of the present invention. These and other changes or modifications are intended to be included within the scope of the present invention, as expressed in the following claims.

The invention claimed is:

1. A tamper configured to be integrally coupled to a container filler, the tamper comprising:

a tamper side surface at least partially comprising an internal surface of a conduit, wherein the conduit is interposed between a top opening and a bottom opening of the container filler, wherein the tamper side surface at least partially mirrors a shape of an internal side surface of a container; and a tamping face configured to move vertically for tamping, wherein the tamping face is configured to move laterally along a horizontal path from a first position located outside of a channel interior to the conduit to a second position located interior to the channel, wherein a perimeter of the tamping face is configured to mirror an opening of the container.

2. The tamper of claim 1, wherein a side surface of the tamper is shaped to mirror the shape of an interior wall of the container.

3. The tamper of claim 1, wherein the tamping face comprises surface features configured to reduce material from adhering to the tamping face.

4. The tamper of claim 1, wherein the surface features comprise a series of raised ridges.

5. The tamper of claim 1, wherein the tamping face is made from molded plastic.

6. The tamper of claim 1, wherein the tamping face is configured to compress material in a container in a direction towards the bottom of the container.

7. The tamper of claim 1, wherein a side face of the tamper is configured to mirror the shape of at least one side of a bottom opening of the container filler.

8. The tamper of claim 1, wherein a material for filling the container is received through a top opening of the container filler and delivered via a conduit to a bottom opening of the container filler.

9. The tamper of claim 1, wherein the perimeter of the tamping face is configured to mirror the shape of a bottom opening of the container filler.

10. The tamper of claim 1, wherein the tamping face is configured to clear material from a conduit of the container filler as the tamping face moves vertically.

11. The tamper of claim 1, wherein a tamping face is configured to retract vertically post tamping.

12. The tamper of claim 1, wherein a side surface of the tamper is configured to comprise a portion of a conduit of the container filler.

13. The tamper of claim 1, wherein a material for filling the container comprises at least one of a fruit or a vegetable.

14. The tamper of claim 1, wherein the tamping face is located outside of an interior channel between a top opening and a bottom opening of a conduit of the container filler while the tamper is in a first position.

15. The tamper of claim 1, wherein a fully extended tamper face is located outside of the container filler.

16. A method of filling a container and tamping material within the container comprising:

receiving product via a top opening of a filler;

delivering the material via a conduit to the container through a bottom opening of the filler; and tamping the material in the container by a tamper having a tamping face and a tamper side surface, wherein the tamper is interposed between the top opening and the bottom opening of the filler, wherein the tamper side surface at least partially comprises an internal vertical surface of the conduit, wherein the tamping face is configured to vertically compress the material in the container, wherein the tamping face is configured to move laterally along a horizontal path from a first position located outside of a channel interior to the conduit to a second position located interior to the channel and wherein the shape of the tamping face is configured to mirror an internal shape of the container.

17. The method of claim 16, further comprising aiding, via the tamper side surface integral to the tamper, the material delivery to the container, wherein the face of the tamper side surface is oriented orthogonal the tamping face.

18. The method of claim 16, wherein the surface features comprise a series of raised ridges.

* * * * *